United States Patent [19]

Hardwick et al.

[11] 4,140,045

[45] Feb. 20, 1979

[54] PISTON POSITIONING INDICATOR

[75] Inventors: C. Thomas Hardwick, Miami; Steven R. Webb, Tulsa, both of Okla.

[73] Assignee: Fenix & Scisson, Inc., Tulsa, Okla.

[21] Appl. No.: 769,308

[22] Filed: Feb. 16, 1977

Related U.S. Application Data

[63] Continuation of Ser. No. 633,252, Nov. 19, 1975, abandoned.

[51] Int. Cl.[2] ..... F01B 25/26; F01B 31/12

[52] U.S. Cl. ..... 92/5 R; 200/82 R; 200/82 D; 200/83 F

[58] Field of Search ..... 92/5 R, 5 L; 200/82 R, 200/81.9 HG, 83 F, 81.4, 283, 244, 82 C, 82 D; 340/52 C

[56] References Cited

U.S. PATENT DOCUMENTS

| | | | |
|---|---|---|---|
| 777,677 | 12/1904 | Kettering | 200/82 D |
| 2,552,746 | 5/1951 | Steider | 200/83 F |
| 3,003,473 | 10/1961 | Ottoson | 92/5 R |
| 3,303,755 | 2/1967 | Linker | 92/5 R |
| 3,336,451 | 8/1967 | Burton | 200/82 D |
| 3,411,133 | 11/1968 | Gardner | 200/82 R |
| 3,457,384 | 7/1969 | Topfer | 200/82 R |
| 3,466,978 | 9/1969 | Carlstedt | 92/5 R |
| 3,546,667 | 12/1970 | Thomas | 200/82 R |
| 3,610,853 | 10/1971 | Reznicek | 200/82 D |
| 3,715,538 | 2/1973 | Ito | 200/82 D |
| 3,721,791 | 3/1973 | Grieves | 200/283 |
| 3,912,893 | 10/1975 | Stoler | 200/82 C |

FOREIGN PATENT DOCUMENTS

| | | | |
|---|---|---|---|
| 512878 | 6/1929 | Fed. Rep. of Germany | 200/83 F |
| 1601763 | 3/1970 | Fed. Rep. of Germany | 92/5 R |
| 1449240 | 10/1965 | France | 200/82 C |
| 487118 | 11/1953 | Italy | 200/83 F |

*Primary Examiner*—Martin P. Schwadron
*Assistant Examiner*—Abraham Hershkovitz
*Attorney, Agent, or Firm*—Head, Johnson & Chafin

[57] ABSTRACT

In a piston actuated valve, means for determining the position of the operating piston by means of at least one insulated contact probe which is inserted through the wall of the cylinder. Two or more can be used, one in each extreme position of the piston. As the piston moves into its extreme position, contact is made with the probe and a suitable signal is sent, indicating that the piston is in that extreme position.

2 Claims, 3 Drawing Figures

PISTON POSITIONING INDICATOR

This is a continuation of application Ser. No. 633,252 filed Nov. 19, 1975 and now abandoned.

BACKGROUND OF THE INVENTION

FIELD OF THE INVENTION

This invention lies in the field of remote indicating devices. More particularly, it is concerned with indicating the position of a piston within a cylinder. An example of the application of the invention is its use with a remotely controlled and operated valve, the valve closure member being positioned by means of a piston in a cylinder through which a control fluid is passed.

In the prior art, there has been no way of detecting or indicating the position of the piston in such a remote controlled device except by having the piston rod itself be sealed through and project beyond the end of the cylinder. This involves additional expense and difficulty from leakage through the seals, etc.

SUMMARY OF THE INVENTION

It is the primary object of this invention to provide a simple and reliable means for indicating on the exterior of the cylinder, the position of the piston inside the cylinder. This is done by inserting and sealing one or more probes through the wall of the cylinder, such that the piston in moving to its extreme position presses against the probe and closes an electrical circuit, which can sound an alarm or indicate on signal lights, etc. The probe is a simple device which can be installed in the form of a plug which is screwed into a threaded hole in the wall of the cylinder. The probe is held in the plug by means of a tubular compliant insulator through which the probe is pressed. The insulator is held in the plug by means of a cap which screws onto the plug. There are, of course, other ways in which the device can be constructed, but essentially it is an insulated support for a metal probe which is adapted to be pressed against by the piston moving to its extreme position. When the piston contacts the probe, it can directly close an electrical circuit including a battery and signal device connected between the probe and the cylinder wall. Alternatively, it can deflect the probe by a small amount in order to make contact with an auxiliary contact which is part of the probe assembly itself.

BRIEF DESCRIPTION OF THE DRAWINGS

It is a primary object of this invention to provide a simple, convenient, and inexpensive means to close an electrical circuit whenever the piston in a control valve reaches a selected position.

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
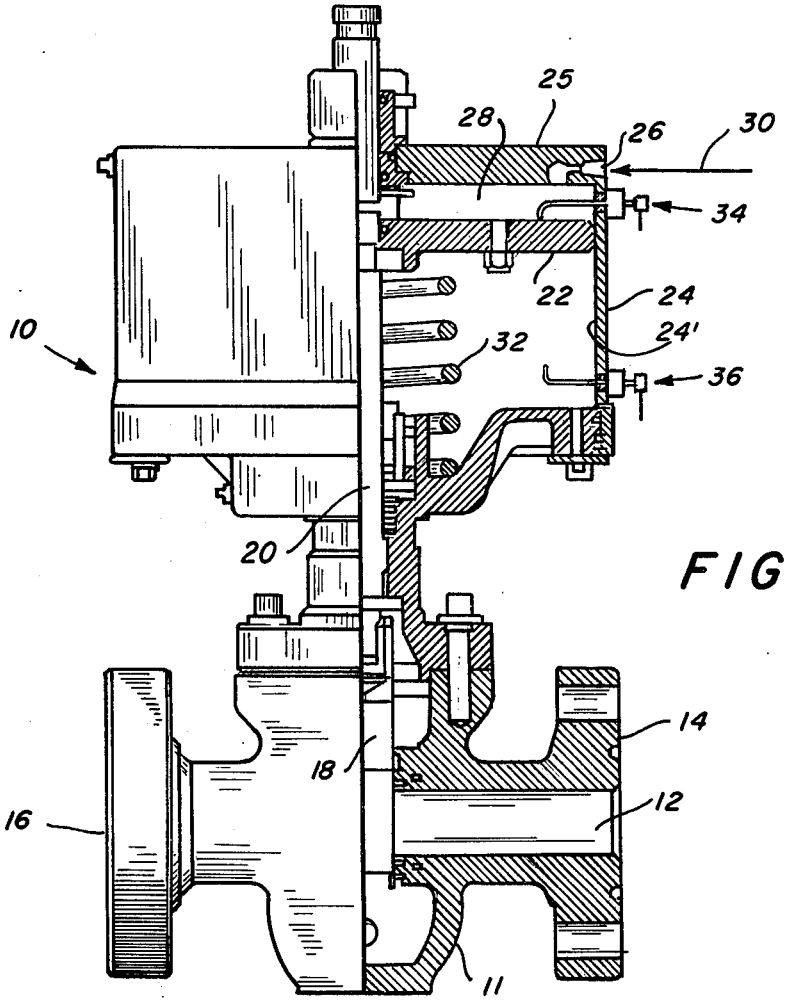
FIG. 1 illustrates a conventional type of remote controlled fluid assisted valve and on which is indicated the attachment of two probes for indicating the extreme positions of the piston.

Referring now to the drawings, there is shown in FIG. 1 a conventional type of remote controlled valve indicated generally by the numeral 10. This comprises a housing 11 having a bore or fluid passage 12 between two ends 14 and 16 which are in the form of flanges to which pipes can be bolted. There is a central volume in the housing and a gate 18 which is adapted to be moved perpendicular to the bore 12 so as to close or open the passage through the bore 12. The gate 18 is attached to an actuator stem or rod 20 which is sealed through and moves in a second housing, which is essentially a cylinder having a cylindrical wall 24 and head 25. There is a piston 22 which is attached to the actuating stem 20 which forms a piston rod. The piston is adapted to move longitudinally in the cylinder 24 and is sealed by means of an "O" ring 38 against the internal wall 24 of the cylinder.

There is a space 28 between the piston 22 and cylinder head 25. An opening 26 to which a pipe can be attached provides for the flow of control or operating fluid, indicated by arrows 30, so that a pressure fluid can flow into the space 28 and cause the piston 22 to be moved downwardly against the force of the spring 32, so as to move the gate in a position to intercept the passage 12 and close the valve. When the pressure fluid 30 is removed, the spring 32 then forces the piston 22 up, to move to its upper position, thus lifting the actuator stem and with it the gate 18, opening the passage 12.

The problem is how to determine where the piston is at any given time, that is, whether it is in its outer, or upper, extreme position, in which the valve is open, or in its lower or inner extreme position, in which the valve is closed.

Means are provided, including the two contact devices 34 and 36, to indicate the extreme position of the piston. These are illustrated in greater detail in FIG. 2 but are positioned through the wall 24 of the cylinder so as to insert an insulated probe 40 through the wall of the cylinder in such a position that as the piston moves to one extreme of its motion, or the other, it presses against the point 44 of the probe. This contact between the probe 44 and the piston 22 closes an electrical circuit which includes a wire 56 attached to the outer end 46 of the probe. A wire 58 attached by means of screw 60 to the cylinder, a battery 62 or other power source, and a signaling device 64 which might be a bell, horn, or lamp, or other signal means, to show that the piston is in contact with the particular probe at the moment.

Figure 2:
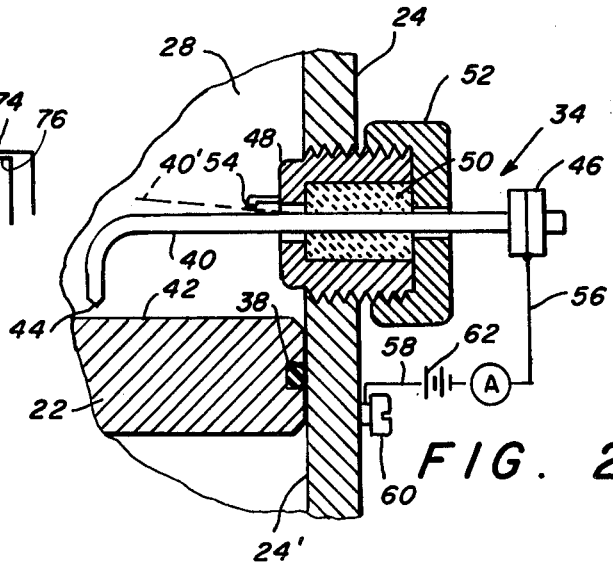
FIG. 2 is an enlarged view of the piston and cylinder showing detail of the probe assembly.

There is shown in FIG. 2 one embodiment of the probe which comprises a plug 48 having appropriate threads on its outer surface adapted to be threaded into and seal the plug into the cylinder wall 24. There is a central cylindrical bore into which is placed a cylindrical plug of compressible insulating material, such as rubber or other appropriate compressible insulating material, which is adapted to stand whatever temperature or pressure is involved in the operation. The cylindrical tubular insulating plug 50 is placed around the rod 40, which is the contact rod, which can be of suitable metal having the proper rigidity. The insulating sleeve 50 is held tightly inside the cavity of the plug 48 by means of a threaded cap 52 as shown. There are appropriate central openings in the plug and the cap so that there is no contact between the rod 40 and the plug or cap. The only way that an electrical circuit can be made between the probe 40 and the cylinder 24 is through the medium of an electrical contact between the tip 44 of the probe and the piston 22, or alternatively, a pressure of the piston on the point 44 of the probe causing it to deflect in accordance with the dashed line 40' and make contact with an auxiliary contact 54 which is part of the plug 48. As the piston moves to its upper position, it either makes contact directly with the probe or by its continued upward movement deflects the probe and causes it to make contact with the auxiliary electrode 54 and thus close the circuit through the wire 56 and 58, the power source 62, and the signaling device 64.

Figure 3:
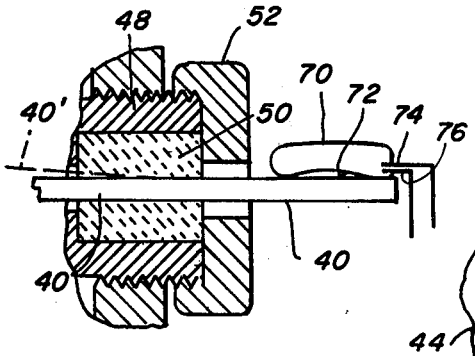
FIG. 3 illustrates a second embodiment of the apparatus of FIG. 2.

There is shown in FIG. 3 a portion of a probe assembly which is a modification of the probe of FIG. 2 in which the insulating material is flexible enough so that when there is pressure on the point 44 of the probe 40, due to the upward motion of the piston, the slope of the line 40' will be sufficient so that a mercury contact bulb 70 having a drop of mercury 72, which will flow to the lower end, and appropriate connection will be made to the electrodes 74 and 76 by the mercury when the piston is in its upper position, and so on. In this way the electrical contacts are made entirely separately from the metal housing of the valve and of the control plug and provides a preferable type of electrical system.

While the invention has been described with a certain degree or particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. A piston slidably received in a cylinder, and fluid pressure means to move said piston longitudinally in said cylinder;

the improvement in means to indicate externally of said cylinder the position of said piston in said cylinder, comprising:

(a) at least a first insulated contact device inserted through a wall of said cylinder, and positioned so as to be pressed against by said piston as it moves to its first extreme position;

(b) said contact device comprising;

(1) tubular housing means inserted, locked, and sealed through said wall of said cylinder, said housing means comprising a cavity;

(2) elastomeric insulating means inserted into said cavity in said housing means;

(3) a substantially rigid rod-like probe means inserted through an axial opening in said insulating means into said cylinder; and (4) means to compress said insulating means and cause it to clamp and hold said probe means while permitting lateral deflection of the probe means at the point of clamping of said probe means due to deformation of said elastomeric insulating means so that said probe means including the portion externally of said cylinder is laterally deflected through a selected angle;

whereby when said piston presses against said probe means said probe means will be deflected from its normal position; and (d) means attached to said probe means externally of said cylinder to provide a signal in response to the deflection thereof.

2. The apparatus as in claim 1 including at least a second insulated contact device positioned so as to be pressed against by said piston as it moves to its second extreme position;

whereby when said piston is in its first or second extreme position, either said first or said second contact device will provide a corresponding signal.

* * * * *